United States Patent [19]

Berney

[11] 4,199,932

[45] Apr. 29, 1980

[54] ELECTRONIC TIMEPIECE WITH MIXED TIME SETTING

[75] Inventor: Jean-Claude Berney, Epalinges, Switzerland

[73] Assignee: Ebauches SA, Neuchatel, Switzerland

[21] Appl. No.: 917,537

[22] Filed: Jun. 21, 1978

[30] Foreign Application Priority Data

Jul. 5, 1977 [CH] Switzerland ..... 8226/77

[51] Int. Cl.[2] ..... G04C 9/00; G04B 27/00

[52] U.S. Cl. ..... 368/80; 368/188

[58] Field of Search ..... 58/23 R, 34, 35 R, 63, 58/85.5, 24 R, 26 R, 23 D, 28 D, 126 R, 126 D

[56] References Cited

U.S. PATENT DOCUMENTS

| | | | |
|---|---|---|---|
| 2,198,632 | 4/1940 | Mullan | 58/34 |
| 2,860,481 | 11/1958 | Black | 58/34 |
| 3,739,568 | 6/1973 | Van Haaften | 58/24 R |
| 3,810,356 | 5/1974 | Fujita | 58/23 R |
| 3,841,081 | 10/1974 | Komaki | 58/23 R |
| 3,948,036 | 4/1976 | Morokawa | 58/23 R |
| 4,030,283 | 6/1977 | Sauthier et al. | 58/23 R |

FOREIGN PATENT DOCUMENTS

| | | | |
|---|---|---|---|
| 2168093 | 8/1973 | France | 58/85.5 |

*Primary Examiner*—Vit W. Miska

*Attorney, Agent, or Firm*—Wender, Murase & White

[57] ABSTRACT

An electronic timepiece having an analog display including a time setting mechanism for correction of the hour hand independently of the other hands including an auxiliary circuit for supplying a rapid frequency train of pulses to a step motor for displacing a train of gear wheels by an amount equivalent to a complete turn of the second hand.

5 Claims, 4 Drawing Figures

ELECTRONIC TIMEPIECE WITH MIXED TIME SETTING

BACKGROUND OF THE INVENTION

The present invention relates to an electronic timepiece with mixed time setting, comprising a step motor driving, by means of a gear train, at least seconds, minutes and hour hands, an integrated circuit incorporating, among other components, an oscillator, a frequency divider, a control and time setting circuits and a feed circuit capable of supplying the motor with pulses of normal frequency, of rapid frequency or of zero frequency, a quartz resonator, an electric feed source and control and time setting means comprising at least one time setting stem actuating a first contact, a push button actuating a second contact and an hour-by-hour mechanical or magnetic correcting device making it possible to correct the position of the hour hand by steps of 1/12th of a turn without affecting the display of the minutes and seconds.

An object of the present invention is to provide a simplification of the time setting mechanism of an electronic timepiece with analog display, comprising a device making it possible to correct the position of the hour hand independently of that of the other hands by steps of 1/12th of a turn, for example to change of a time-zone. The mechanical simplification is obtained by the addition of an electronic circuit to the integrated circuit, for it is known that the price of such a circuit is only slightly influenced by the addition of a few extra components.

According to the present invention there is provided an electronic timepiece with mixed time setting, comprising a step motor, driving, by way of a train of gear wheels, at least the seconds, minutes and hour hands, an integrated circuit incorporating among other components, an oscillator, a frequency divider, a control and time setting circuit and a feed circuit capable of supplying the motor with pulses of normal frequency, of rapid frequency or of zero frequency, a quartz resonator, an electric feed source and control and time setting means, comprising at least one time setting stem actuating a first contact, a push button actuating a second contact and an hour-by-hour mechanical or magnetic correction device, making it possible to correct the position of the hour hand by 1/12 of a turn without affecting the display of the minutes and seconds, in which the integrated circuit comprises an auxiliary circuit controlled by the action of the second contact and arranged in such manner as to supply the motor, by way of the feed circuit, with trains of driving pulses of rapid frequency corresponding to the displacement of the gear wheels by an amount equivalent to a complete turn of the seconds hand, the time-setting stem having a specific axial position in which it actuates the first contact and simultaneously engages the hour-by-hour correction device.

The present invention will be described further, by way of example, with reference to the accompanying drawings.

DESCRIPTION OF THE PREFERRED EMBODIMENTS

Figure 1:
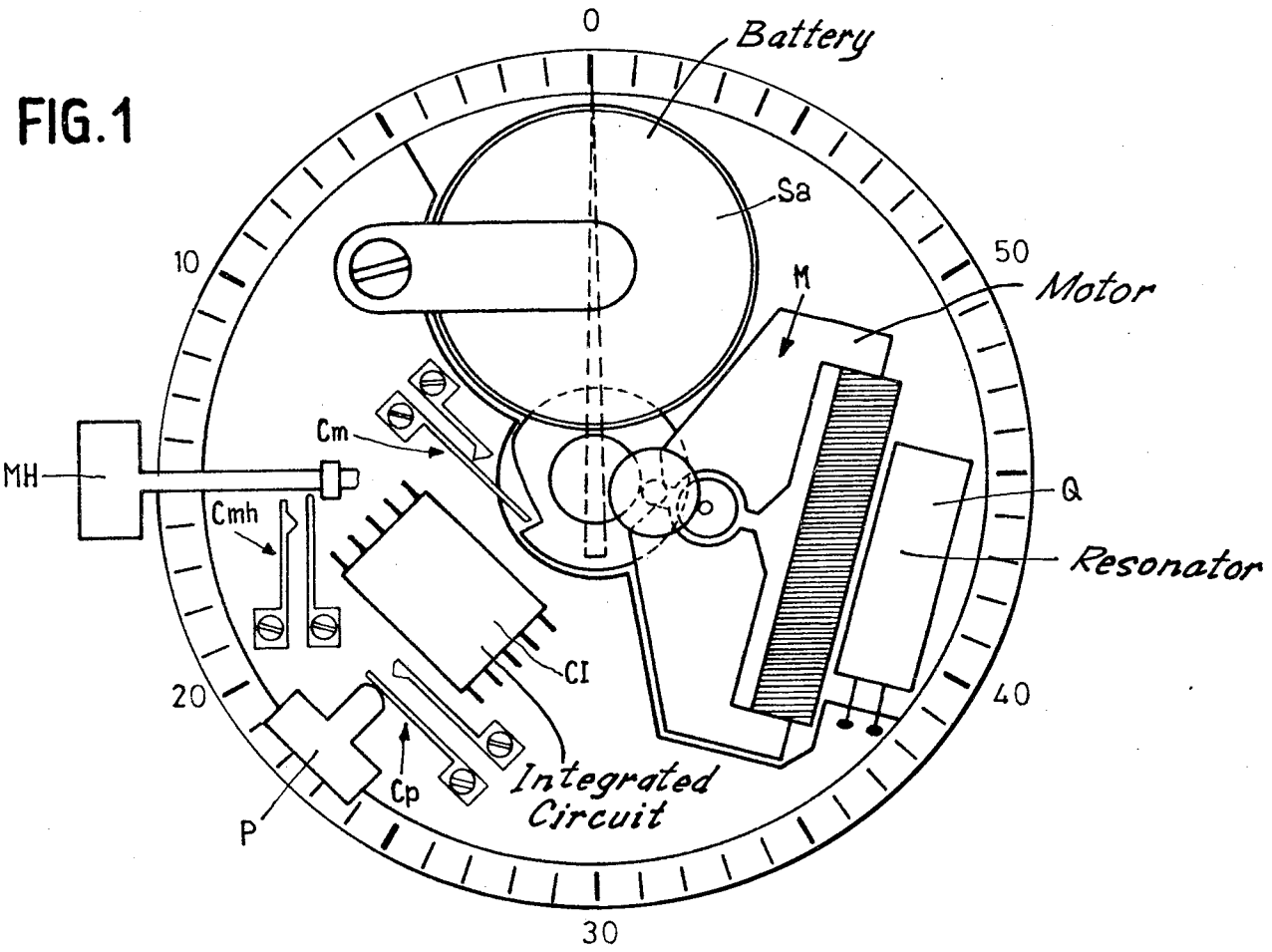
FIG. 1 is a diagrammatic underside view of a preferred embodiment of a timepiece with mixed time setting according to the invention showing the arrangement of the components.

FIG. 1 shows a schematic representation of an analog quartz watch. This watch comprises a quartz crystal resonator Q for the time base, an integrated circuit CI which combines all the electronic circuits of the watch, a step motor M which drives the gear wheels of the hands and an electric supply source Sa. The watch also comprises a contact Cm controlled by a mechanical device attached to the seconds hand, this contact being actuated once for each turn of the seconds hand when it passes through the position 0. The watch also has a push button P, which actuates a contact Cp when pressure is applied to it, a time-setting stem MH and a contact Cmh actuated by the stem MH. The time-setting stem MH has at least one specific axial position in which it actuates a contact Cmh and simultaneously engages a mechanical or magnetic device which, by rotation of the stem MH, makes it possible to modify the position of the hour hand by steps of 1/12th of a turn, without affecting the display of the minutes and seconds, for example, during the change of the hour according to the change of a time-zone. This device, well known in the art, is not shown in the figures.

Figure 2:
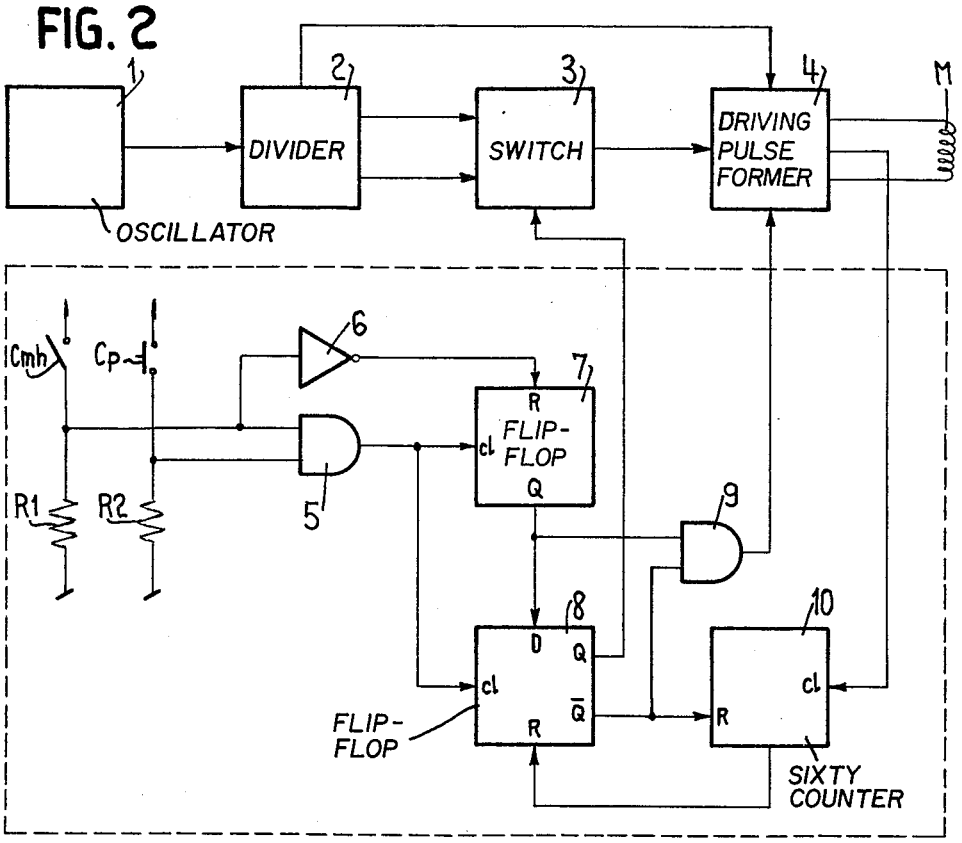
FIG. 2 is a block diagram of a first embodiment of an electronic circuit of the timepiece according to the invention.

FIG. 2 shows a first type of circuit according to the invention. This circuit comprises a quartz oscillator 1 connected to the input of a divider 2. Two outputs of this divider 2 are connected to two inputs of an electronic switch 3, an output of which is connected to an input of a driving pulse former 4. A second input of the former 4 is connected to a third output of the divider 2. Two outputs of the former 4 supply the coil of the bipolar step motor M. The contact Cmh actuated by the time setting stem MH is connected to ground via a resistor R1, to a first input of an AND gate 5, and to the input of an inverter 6, the output of which is applied to the reset input of a flip-flop (FF) 7. The contact Cp actuated by the push button P is connected to ground through a resistor R2 and also to a second input of the AND gate 5. The output of the AND gate 5 is connected to the clock inputs of the flip-flop 7 and of a flip-flop (FF) 8. The Q output of FF7 is applied to the D input of FF8 and to a first input of an AND gate 9. The Q output of FF8 is connected to a third input of the switch 3, whilst the $\overline{Q}$ output of FF8 is connected, on the one hand, to the reset input of a six decade counter 10, and, on the other hand, to a second input of the AND gate 9, the output of which is applied to an enable input of the former 4. The reset input of FF8 is connected to a decoded output of the counter 10. The clock input of this counter 10 is connected to an output of the former 4.

The operation of this circuit is as follows:

The oscillator 1 produces a signal of a specific frequency which is applied to the divider 2, which then produces two output signals which are applied to the switch 3. One of these signals, of 1 Hz frequency, corresponds to the normal advance of the motor, the other, of 32 Hz frequency for example, corresponds to the rapid advance of the motor. The switch 3 selects either of these signals according to its state. The former 4 delivers pulses of alternating polarity to the coil of the motor M, the duration of these pulses being fixed by a signal of higher frequency, for example 64 Hz, provided by the third output of the divider 2. The output of the former 4 which is connected to the clock input of the counter 10 delivers pulses of the same frequency as those supplied to the coil of the motor M. Stopping or working of the watch is determined by the state of the enable input of the former 4. When the contact Cmh is open, the output of the inverter 6 and thus the reset input of FF7, is at logic state 1, so that the Q output of FF7 is kept at 0, as the output of the gate 9, and the enable input of the former 4, and that the motor works. Further the Q output of FF8, which controls the switch 3 is at 0, so that the switch 3 selects the 1 Hz signal and the motor operates at the normal rate.

When the contact Cmh is closed, by pulling out the time-setting stem MH, the first input of the gate 5 passes to 1 and the output of the inverter 6, and hence the reset input of FF7 goes to 0. Upon the first subsequent closure of Cp, when P is pressed, the second input of the gate 5 goes to 1 so that its output goes to 1, which then switches FF7, the Q output of which goes to 1, whilst the state of FF8 remains unchanged. The output of the gate 9, i.e. the enable input of the former 4, goes to 1, so that the motor stops. Upon the second subsequent closing of Cp, FF7 remains in its state when FF8, which receives a clock signal, registers the state of FF7 present at its D input, its Q output passes to 1 and simultaneously its output $\overline{Q}$ passes to 0. The result of this change of state of FF8 is that the switch 3 selects the 32 Hz rapid advance signal and that the enable input of the former 4 is at 0. The motor advances at rapid speed. At the same time, the counter 10, whose reset input has been set to 0, receives the pulses of the former 4 having the same frequency as those feeding the motor. When the counter 10 passes from state 59 to 0 (60th pulse), it delivers a short pulse on its decoded output which activates the reset input of FF8 and forces it to change its state again. The $\overline{Q}$ output of FF8 passes to 1 and the output of the gate 9, hence the enable input of the former 4, passes to 1, the motor stops, and simultaneously the switch 3 returns to a normal advance of 1 Hz. For each renewed actuation of Cp, the process is the same, the Q output of FF8 changes to 1, the motor then advances by 60 steps (1 minute) at rapid speed, then the output Q of FF8 changes again to 0 and the motor stops. It is therefore possible to advance the watch by a whole minute with each actuation of the button P which closes the contact Cp. At the end of the desired correction, the contact Cmh is opened by depressing the stem MH again, and the output of the inverter 6, and hence the reset input of FF7, goes to 1 and the Q output of FF7 is returned to 0. The Q output of FF8 is also at zero. The output of the gate 9 then passes to zero, thus unblocking the former 4 and the motor resumes its normal operation. If the contact Cmh is opened by pushing down the stem MH during a rapid advance cycle of the motor, the cycle is concluded at the 60th step. The decoded output of the counter 10 then delivers the short pulse which resets FF8 to 0. The switch 3 returns to select normal advance, but the output of the gate 9 remains at zero, since FF7 has been reset at 0 by opening of Cmh. The motor does not stop but passes without transition to normal advance at the end of the rapid advance cycle.

To sum up, by pulling stem MH, the hour correction device is engaged. It is therefore possible to set the watch to the correct time by this mechanical device, by correcting the hour units by the time setting crown and the minute units by depressing the button P. It is therefore not necessary to provide an extra mechanical device for the correction of the minutes hand. Similarly, the mechanical hour correction device may be used directly for setting the date.

Figure 3:
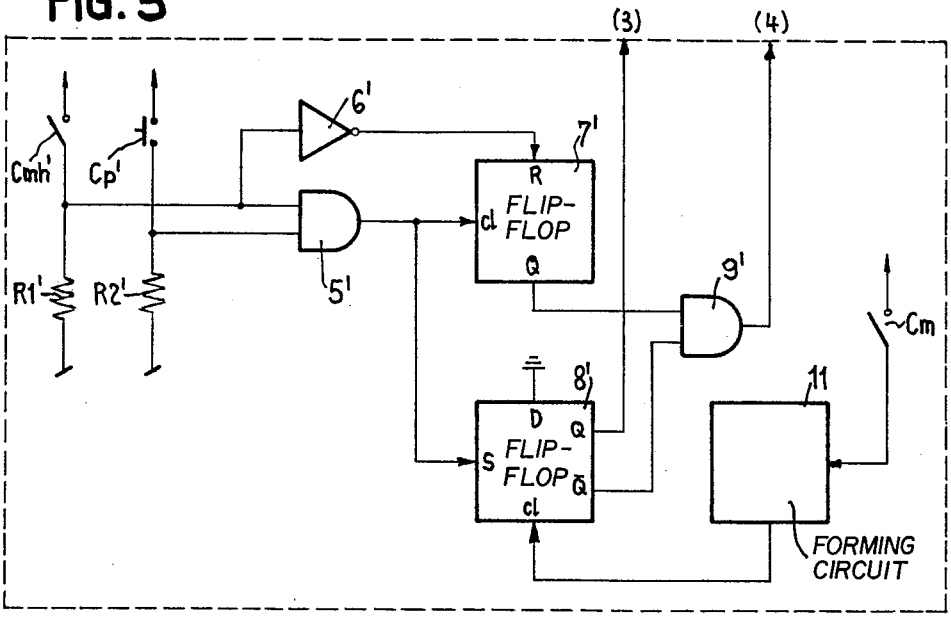
FIG. 3 is a block diagram of a second embodiment of an electronic circuit of the timepiece according to the invention.

FIG. 3 shows, by way of example, a second type of circuit according to the invention which is a variation of the first type, using a minutes contact Cm actuated by the gear train.

The oscillator 1, the divider 2, the switch 3, the former 4, and the coil of the motor M are connected together as in FIG. 2 and are not shown. A contact Cmh' actuated by the time setting stem MH is connected to ground via a resistor R1' and to the first input of an AND gate 5', and to the input of an inverter 6', the output of which is applied to the reset input of a flip-flop 7'. A contact Cp' actuated by the push button P is connected to ground via a resistor R2' and to the second input of the gate 5'. The output of the gate 5' is connected to the clock input of FF7' and to the set input of a flip-flop 8'. The Q output of FF7' is applied to the first input of an AND gate 9', whilst the $\overline{Q}$ of FF8' is applied to the second input of the gate 9', the output of which is connected to the enable input of the former 4. The Q output of FF8' is connected to the third input of the switch 3. The contact Cm, controlled by a mechanical device connected to the seconds hand, is connected to the input of a forming circuit 11, the output of which is applied to the clock input of FF8', the D input of which is connected to ground.

The operation of this circuit is as follows:

The part not shown, comprising the components 1, 2, 3, 4 and M behaves as in the circuit shown in FIG. 2. However, the former 4 has only two outputs, those which feed the coil of the motor M, the third output being not used. When the contact Cmh' is closed by pulling out the time setting stem MH, the first input of the gate 5' passes to 1 and the output of the inverter 6' and hence the reset input of the FF7' passes to 0. With the first closing of Cp', the second input of the gate 5' passes to 1, and therefore its output, which then switches FF7' and 8'. The Q output of FF8' is then at 1 and the switch 3 selects the rapid advance to 32 Hz. The Q output of FF7' is also at 1, whilst the $\overline{Q}$ output of FF8' is at 0, therefore the output of the gate 9', i.e. the enable input of the former 4, remains at 0, thus the motor operates with rapid speed. When the seconds hand passes through the position 0, the mechanical device, to which it is connected, closes the contact Cm which acts on the forming circuit 11. This circuit 11 then delivers a clock pulse to FF8', the Q output of which goes to 0 since its D input is at 0. The $\overline{Q}$ output of FF8' simultaneously passes to 1. The Q output of FF7' being still at 1, the output of the gate 9', i.e., the enable input of the former 4, passes to 1, consequently the motor stops and the seconds hand is locked in the position 0 second. Thereafter, for each closure of Cp', FF8' changes its output Q, which passes to 1 and controls the switch 3, which then selects rapid advance, and its output $\overline{Q}$ which passes to 0 and controls the gate 9' which unblocks the former 4. The motor then advances at rapid speed until the seconds hand passes again through the position 0 for which the contact Cm closes and switches FF8' again through the forming circuit 11. The switch 3 passes again to normal advance and the motor stops. It is therefore possible to advance the watch by units of 1 minute with each actuation of the button P which controls Cp' and the seconds hand is indexed on the position 0. To set the watch to the right time, it is then only necessary to re-open the contact Cmh' by pushing in the time setting stem MH at the moment of a corresponding time signal. The output of the inverter 6', hence the reset input of the FF7' then passes to 1 and the Q output of FF7' is reset to 0. The output of the gate 9', i.e. the enable input of the former 4 passes to 0 and the motor resumes its operation at normal speed, since FF8' has been reset to 0 by the last closure of Cm. If Cmh' is re-opened during a rapid advance cycle, the motor continues to operate until the closure of Cm which switches FF8' again thus resetting the switch 3 to normal advance. Since FF7' has already been set to 0, by the opening of Cmh' the output of the gate 9' and hence the enable input of the former 4 does not change its state. The motor passes from rapid operation during the passing of the seconds hand through the position 0.

In the two types of circuit presented above, we have seen that when the contact Cmh is closed by pulling out the time setting stem MH, the motor continues to operate normally as long as no pressure is applied to the button P. Friction of the mechanical or magnetic hour correction device should therefore be smaller than the torque of the motor in order not to affect the operation of the motor. This automatically results in a reduction of the maximum torque applied on the date indicator. It is known that in step motors, the positioning torque is clearly higher than the motor torque. It would therefore be useful to stop the motor during mechanical correction, a feature which would make it possible to adjust the friction at a higher value and then to increase the maximum torque on the date indicator. The electronic circuit should then be arranged so as to store the delay caused by this stop and then to supply, at the end of the mechanical correction, a number of driving pulses equivalent to this delay.

Figure 4:
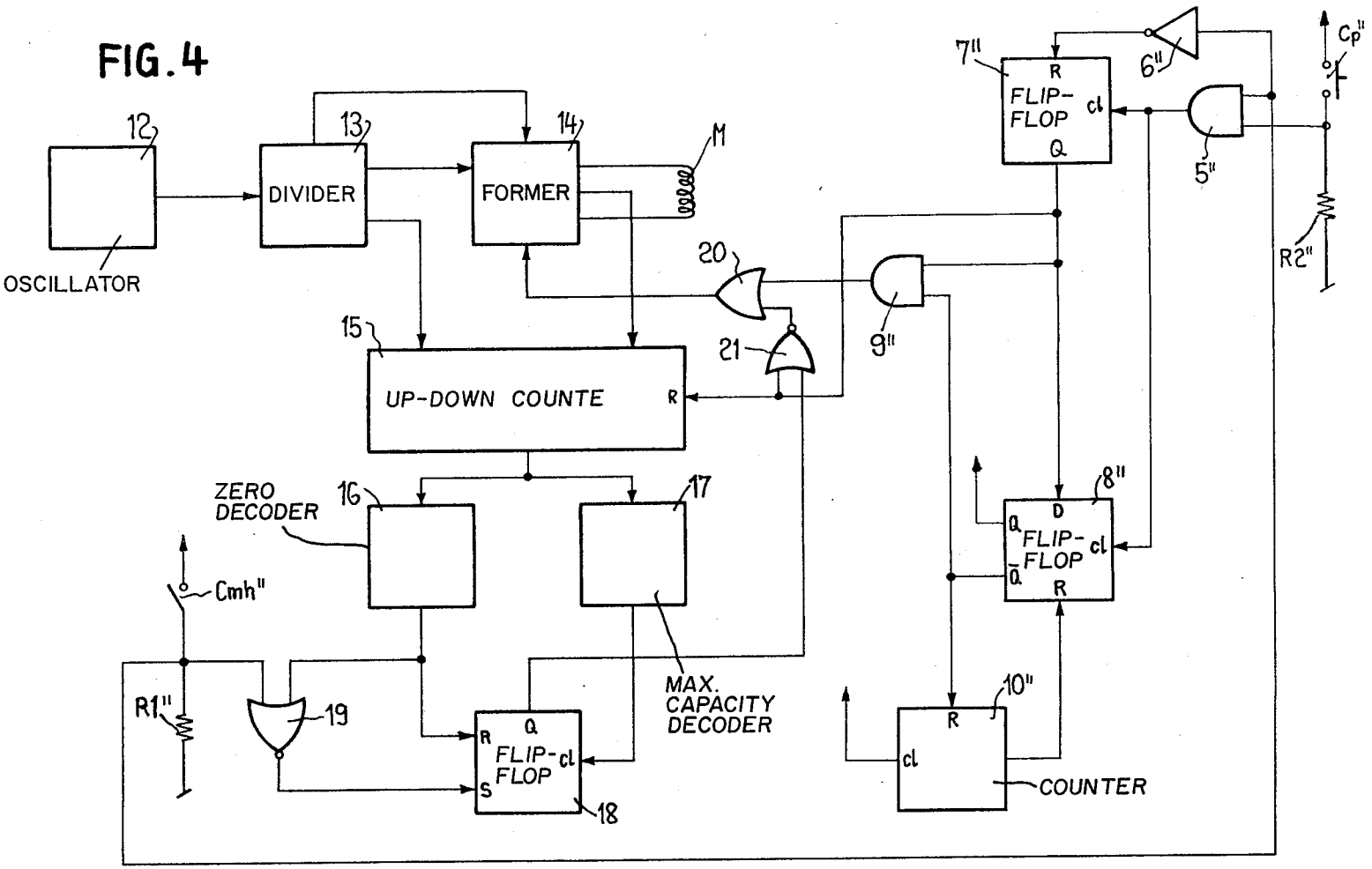
FIG. 4 is a block diagram of one embodiment of an auxiliary electronic circuit of the timepiece according to the invention.

FIG. 4 shows by way of example a type of circuit making it possible to achieve this memorising and restoring function which we shall call overtaking.

This type of circuit is associated either with the circuit shown in FIG. 2 or with that of FIG. 3. Some of the components of these latter circuits are shown in FIG. 4, these are the oscillator 12, the divider 13, the former 14, the motor M, the contact Cmh" and the resistor R1" which correspond respectively to the oscillator 1, the divider 2, the former 4, the motor M, the contact Cmh or Cmh' and the resistor R1 or R1'. Similarly, the components, such as the gate 5", the inverter 6", the flip-flops 7" and 8", the gate 9" and the counter 10" as well as the contact Cp" and the resistor R2" correspond, by way of example, to the components having the corresponding references as in FIG. 2. The switch 3 is no longer necessary for this type of circuit. Thus the circuit comprises the quartz oscillator 12 connected to the input of the divider 13. Two outputs of the divider 13 are applied to two inputs of the former 14, whilst a third output of the divider 13 is connected to the "up" clock input of an up-down-counter 15. Two outputs of the former 14 supply the coil of the motor M and a third output of this former 14 is connected to the "down" clock input of the up-down-counter 15. The outputs of the stages of the counter 15 are applied, on the one hand, to the inputs of the zero decoder 16, and on the other hand, to the inputs of the maximum capacity decoder 17. The output of the decoder 16 is connected to the reset input of the flip-flop 18 and to the first input of a NOR gate 19, the output of which is applied ot the set input of FF18. The second input of the gate 19 is connected to ground via the resistor R1" and to the contact Cmh" actuated by the time setting stem MH. The output of the decoder 17 is connected to the clock input of FF18. The Q output of FF18 is connected to a first input of a NOR gate 21, the output of which is applied to the first input of an OR gate 20. The second input of the gate 21 and the reset input of the counter 15 are connected to the Q output of the flip-flop 7", corresponding to FF7 of FIG. 2 or FF7' of FIG. 3. The second input of the gate 20 is connected to the output of the gate 9", corresponding to the gates 9 or 9' of FIGS. 2 or 3. The output of the gate 20 is applied to the enable input of the former 14.

The operation of this circuit is as follows: Assuming that the counter 15 is at state 0, the output of the decoder 16, hence the reset input of FF18, is at 1. The contact Cmh" remains open, consequently the output of the gate 19, hence the set input of FF18 is at 0. The Q output of FF18, applied to the first input of the gate 21 ist at 0, the second input of this gate, which is connected to the Q output of FF7" is also at 0, therefore the output of this gate is at 1, as is the output of the gate 20, i.e. the enable input of the former 14 and the motor is thus blocked.

The oscillator 12 sends a signal of specific frequency to the divider 13. When the 1 Hz output of the divider 13 which is connected to the "up" clock input of the counter 15 passes to 1, this counter advances by one step and the output of the decoder 16 drops to 0. The set input of FF18 passes to 1, thus the Q output passes to 1. The output of the gate 21 passes to 0, the output of the gate 20 likewise, since its input, connected to the output of the gate 9", is at 0. The former 14 is then unblocked.

As soon as the former 14 receives a pulse of frequency 32 Hz from the divider 13, the motor advances by one step. The duration of the driving pulse is determined by a third signal of higher frequency, for example 64 Hz, transmitted by the divider 13 and applied to the former 14. Simultaneously with the advance of the motor, the former 14 sends a pulse to the "down" clock input of the counter 15 which then returns to 0. The output of the decoder 16 then passes to 1 and the Q output of FF18 passes to 0, consequently the enable input of the former 14 passes to 1 and the motor is blocked again, after having advanced by a single step. The next pulse of the 1 Hz signal to the "up" clock input of the counter 15 unblocks the enable input of the former 14, the motor advances by one step and the former 14 is blocked again, and so on. The motor thus advances at normal speed 1 Hz. By pulling out the time setting stem MH, the contact Cmh" closes, therefore the set input of FF18 is kept permanently at 0. Since the counter 15 is at 0, the output of the decoder 16, hence the reset input of FF18 is at 1, the Q output thereof is at 0, hence the enable input of the former 14 is at 1 and the motor is blocked. The advent of a pulse at the "up" clock input of the counter 15 advances said counter, the output of the decoder 16, hence the reset input of FF18, drops to zero, the set input of this flip-flop is kept at 0, the FF18 therefore maintains its state and the motor remains blocked. The counter 15 then counts the pulses of frequency 1 Hz present on its "up" clock input. When the counter arrives at its maximum capacity, for example 60, the output of the decoder 17 passes to 1 and sends a clock pulse to FF18, the Q output of which rises to 1. The enable input of the former 14 passes to 0, thus permitting the advance of the motor at the frequency delivered by the divider 13, i.e. 32 Hz. Simultaneously the counter receives at its "down" clock input, pulses of the same frequency as those supplied to the motor, it subtracts the pulses which it receives at its "up" clock input which are of frequency 1 Hz. When the counter 15 arrives at 0, the motor has overtaken its delay. The output of the decoder 16 passes to 1 and returns the FF18 to 0, thus activating the enable input of the former 14 and blocking the motor again. The counter 15 advances again to its maximum capacity, thus switching FF18 and permitting rapid advance of the motor, and so on. The circuit makes it possible to stop the motor during mechanical correction of the hour hand, then to overtake the stopping time. During the overtaking phase the output of the decoder 17 is at zero and the Q output of FF18 at 1. By depressing the time setting stem MH at this moment, thus reopening the contact Cmh", the set input of FF18 passes to 1, which has no effect on the state of FF18, the Q output of which is already at 1, so that the motor concludes its rapid advance cycle. When the counter 15 then returns to 0, FF18 changes state and the motor continues its normal operation as described above. During the stopping phase of the motor, the Q output of FF18 is at 0 as is the output of the decoder 16. By depressing the time setting stem MH at this moment, thus reopening the contact Cmh", the set input of FF18 passes to 1 and changes the Q output to 1 which unblocks the former 14. The motor then overtakes at rapid speed the equivalent of the stopping time. As soon as the counter 15 returns to 0, FF18 changes state again and the motor resumes normal operation.

The above described system concerns only the overtaking function. Let us examine the case in which a correction is effected by a unit of one minute as we have described with reference to FIGS. 2 and 3. The time setting stem MH is pulled out, Cmh" is closed and the motor operates normally. By applying pressure to the button P, thus closing the contact Cp", FF7" is changed over, the Q output of which is connected to the reset input of the counter 15 and to the second input of the gate 21, both of which are kept at 0. The overtaking function is inhibited. For the remainder of the operation the circuits shown in FIGS. 2 and 3 function as have been described above, the state of the output of the gate 9" is transmitted to the enable input of the former 14 through the gate 20.

I claim:

1. An electronic timepiece with mixed time setting, comprising:

means for producing time base pulses of a first and second frequency;

a stepping motor driven from said time base pulses;

a seconds hand driven by said stepping motor;

a minutes hand and an hours hand driven by said seconds hand;

means for manually setting said hours hand independently of said seconds and minutes hands by steps of 1/12 of a turn;

means coupled to said hour setting means for producing a first control signal;

control means coupled to said time base producing means for interrupting said time base pulses stopping said motor, and for selecting said second frequency time base pulses, said selected pulses rapidly driving said motor whereby said seconds hand is rapidly advanced; and means coupled to said control means for providing a detection signal;

said control means further responsive to said detection signal for interrupting said second frequency time base pulses stopping said rapid advance of said seconds hand.

2. An electronic timepiece according to claim 1, further comprising:

means coupled to said control means for manually producing a second control signal;

said control means further responsive to said first control signal and said manually produced second control signal for causing said motor to rapidly advance said seconds hand.

3. An electronic timepiece according to claim 2, wherein said means for providing a detection signal is responsive to said selected time base pulses, and includes means for counting said pulses and delivering said detection signal every 60th pulse, thereby allowing said seconds hand to be rapidly advanced one complete turn.

4. An electronic timepiece according to claim 3 wherein said means for providing a detection signal includes means for producing a signal when said seconds hand is in a predetermined position.

5. An electronic timepiece according to claim 1, wherein said control means includes overtaking means responsive to said first control signal for interrupting said first frequency time base pulses thus stopping said motor, and for storing said interrupted time base pulses, said overtaking means further responsive to the disappearance of said first control signal for causing said motor to drive said seconds hand for a number of steps corresponding to the number of stored time base pulses.

* * * * *